United States Patent [19]

Marella et al.

[11] Patent Number: 4,731,048

[45] Date of Patent: Mar. 15, 1988

[54] METHOD OF MAKING ENVELOPE AND LETTER ASSEMBLY WITH BUSINESS LETTER FOLD

[75] Inventors: Gary L. Marella, Minnetonka; David T. Gardella, Long Lake, both of Minn.

[73] Assignee: Victory Envelope, Inc., Chanhassen, Minn.

[21] Appl. No.: 942,610

[22] Filed: Dec. 17, 1986

[51] Int. Cl.[4] ..... F16H 55/36

[52] U.S. Cl. ..... 493/188; 493/216; 493/228; 493/231; 493/921; 229/92.1

[58] Field of Search ..... 493/216, 223, 224, 228, 493/231, 246, 249, 917, 920, 921, 188; 53/206, 460; 229/92.1, 92.3, 92.5, 92.7, 75

[56] References Cited

U.S. PATENT DOCUMENTS

| | | | |
|---|---|---|---|
| 1,229,442 | 6/1917 | Gruhler | 229/92.7 |
| 1,567,875 | 12/1925 | Swanson | 229/92.1 |
| 3,557,519 | 1/1971 | Lyon et al. | 53/31 |
| 3,998,138 | 12/1976 | Walters | 53/31 |
| 4,091,596 | 5/1978 | Jones | 53/31 |
| 4,189,895 | 2/1980 | Volkert et al. | 53/429 |
| 4,411,643 | 10/1983 | Higginson | 493/188 |
| 4,530,730 | 7/1985 | Bradley et al. | 156/227 |
| 4,530,731 | 7/1985 | Bradley | 156/227 |
| 4,531,993 | 7/1985 | Bradley | 156/227 |
| 4,600,141 | 7/1986 | Bradley et al. | 229/92.7 |
| 4,630,768 | 12/1986 | Bradley | 229/92.7 |

*Primary Examiner*—Frederick R. Schmidt
*Assistant Examiner*—Robert Showalter
*Attorney, Agent, or Firm*—Schroeder & Siegfried

[57] ABSTRACT

A method for producing mass quantities of discrete envelope and letter assemblies in a continuous operation, each of which includes an envelope and a separate letter having a business-fold disposed within the envelope, both formed from the same single sheet of material, and enabling the producer to print a personalized letter upon the sheet prior to the formation of the envelope assembly. The highly desirable end result which is attained is that the completed letter is in a business-letter-fold and the sheet moves continuously forward as the assembly is formed, such that the salutory heading of the letter opens to view when the letter is withdrawn from the envelope, and the signatory panel is folded between the salutation panel and the intermediate portion of the letter. The method is capable of continuous operation inasmuch as each sheet continuously moves in the same direction throughout each of the steps of the method. Most importantly, however, the method is cost effective for producing, at bulk rates, personalized letters which have a business-fold and are adapted for bulk mailing.

18 Claims, 12 Drawing Figures

METHOD OF MAKING ENVELOPE AND LETTER ASSEMBLY WITH BUSINESS LETTER FOLD

BACKGROUND OF THE PRIOR ART

Various patents describing various related methods of making envelopes with folded enclosures therein have issued in recent years. Among such patents are U.S. Pat. No. 3,557,519 issued to Lyon; U.S. Pat. No. 3,998,138 issued to Walters; U.S. Pat. No. 4,019,596 issued to Jones; U.S. Pat. No. 4,189,895 issued to Volkert et al; and U.S. Pat. No. 4,411,643 issued to Higginson. In addition and most recently U.S. Pat. No. 4,530,730, has issued to Bradley et al and U.S. Pat. No. 4,530,731 and U.S. Pat. No. 4,531,993 have issued to Bradley, all of which are assigned to Bedford Engineering Co., Armonk, N.Y. Of all of these prior patents, U.S. Pat. No. 4,531,933 appears to be most pertinent in that it discloses a method of making an envelope assembly with an enclosure having the Z-type fold which is uniformly used in bulk rate mailing. None of these patents, however, disclose or suggest a cost-effective method by means of which such an assembly can be produced, but in which the letter has a business-fold. Reference is made to columns 1 and 2 of U.S. Pat. No. 4,531,993, issued to Bradley, which are included herein by reference thereto and which sets out the high desirability of mass producing envelope-letter assemblies at high speeds and low costs, with a personalized element. That patent, however, fails to disclose or suggest any method or means by which the letter portion of the assembly could be formed in a business-fold.

U.S. Pat. No. 3,557,519 to Lyon, Jr. describes an integral envelope-letter article intended to provide the effect of a personal letter while retaining the ability to produce such letters in sufficient quantities to be economical within the economic framework of direct mail advertising. Jones, in U.S. Pat. No. 4,091,596, provides a method for producing a mailing piece formed of an envelope and an insert. However, the Jones mailing piece is formed of two separate sheets of material blanked from different webs at different locations and mated in an assembly operation, such methodology being logistically difficult and of a speed which is becoming unacceptable in the industry due to cost considerations.

Jones provides two changes of direction in the manufacture of the mailing piece so disclosed, a first change of direction occurring on insertion of the separate "letter" portion of the mailing piece into an unglued blank with a second change of direction occurring to facilitate application of adhesive to the envelope blank which is followed by folding and sealing of the mailing piece. Changes of direction in such a processing operation inherently increase the time required to manufacture of a mailing piece.

Volkert et al in U.S. Pat. No. 4,189,895 provides an envelope containing a personalized enclosure which is unattached to the personalized envelope, the envelope and enclosure being formed from the same web of sheet material which has been preprinted. Volkert et al do not provide a mechanism within the mailing piece itself during formation which ensures that the envelope and enclosures are maintained in association with each other during folding and severing operations necessary to cause the envelope and enclosure to become separate entities.

The personalization of mail effectively increases the return to the advertiser or other user. Personalized mailings lose a substantial amount of personal value when the person receiving the mailing can easily recognize the mailing as a "form" or "mass" mail advertisement, such poorly produced mailings being often not opened or read by the recipient even though useful and valuable information is contained in the mailing. The use of "computer printout" papers wherein an envelope and "letter" are combined together without detachment and often without even removal of edge perforations remaining from printing from a roll further increases the resistance of a recipient to seriously consider such a mailing as personal mail deserving of close attention.

Accordingly, it has become highly desirable to produce personalized mailing pieces consisting of a personalized envelope and a separate personalized enclosure which are formed from the same preprinted blank of sheet material and which particularity gives the effect of an important, personalized letter or other communication such an a telegram or the like. Further, it is particularily necessary in the production of such mailing pieces that the mailing pieces be produced at a high rate of speed in order than economies can be effected without diminution of the personalized quality of the mailing.

In recent years, business practices have more and more required personalized communications because most business executives receive so much so-called "junk or bulk rate mail" that it is recognized and discarded without any serious attention being given thereto. Executives recognize "junk mail" pieces by the manner in which they are prepared, particularily in view of the fact that business practices have developed in business letter writing what is known as a "business fold". Executives can readily identify so-called "junk mail" as such if it has a Z-fold instead of a business fold. As a consequence, most if not all such Z-folded mail may be summarily discarded without examination or reading of same.

A "business fold" is described as the prescribed manner in which a secretary is taught to fold and insert a dictated business letter into an envelope, and involves first folding the signatory portion of the letter inwardly and then subsequently folding the salutation portion of the letter thereover and inserting the same into the envelope in such a way that the letter has three layers, with the signatory portion in the middle and the salutation portion opening upwardly as the letter is withdrawn from the envelope, when the latter is opened at the top and is held with its backside up.

Thus, it is desirable, for obvious reasons, to be able to produce at high speeds a cost effective personalized letter which is mechanically folded, addressed, and disposed within its envelope assembly in a business fold so that it cannot be readily detected as having been machine-produced as one of large quantities in a continuous process. No one has heretofore disclosed or suggested a method of cost-effectively producing such an envelope assembly, despite the readily recognizable desirability of being able to produce such letters in large quantities and in a continuous operation. Our invention provides a cost-effective method of producing large volumes of such an envelope assembly with the letter having the above described "business-fold" and being disposed within the envelope during the formation of the latter as a direct result of the method of manufacture.

BRIEF SUMMARY OF THE INVENTION

We have developed a cost-effective method of producing large volumes of personalized business letter assemblies for bulk mailing in each of which the letter portion is automatically folded with a business fold and encompassed in a prescribed relation as a result of the method of manufacture by an envelope, all from a single sheet of paper. Bulk rate mail has heretofore uniformly employed non-business or Z-type folding of the letter. While the desirability of using a business-fold in the letter portion of such envelope assemblies has long been heretofore recognized, no one has heretofore found it commercially feasible because it was thought to require manual folding and stuffing of the letter within the envelope. Our method, on a cost benefit basis, is cost-effective so that now such bulk rate mailings can provide, at high speed and high volume and low cost, a business-fold letter rather than the non-business or Z-fold type heretofore used.

In our method, the envelope and the letter are each personalized by preprinting the appropriate portions of the blank of material from which the letter assembly is to be made. Each preprinted blank can be brought to the folding machine separately or it can be fed from a roll of such blanks and cut off as it progresses through the folding machine. The letter is printed on one or both sides of the sheet with the signatory panel at the forward end portion. The folding machines which we utilize are readily available on the market, and have been modified in a manner which will be readily obvious to one skilled in the art to accomplish the various steps of the methods disclosed herein. Each blank is fed into and moved through such a machine at a relatively high speed and travels continuously forwardly therethrough while the envelope assembly is made. The forming and folding of the letter and the envelope is accomplished while the blank or sheet of material moves continuously forwardly. Thus, it is possible to produce as many as 15,000 letters and envelope assemblies, with a business-fold in the letter, per hour, using the new methods described herein.

The invention involves providing an elongated blank of material, such as paper, the forward letter portion of which is rectangular in shape and the trailing portion (envelope portion) of which is also generally rectangular, but has wider portions at each side which are utilized in securing the opposite sides of the eventual envelope together to form the envelope itself. The envelope portion also includes a trailing area which eventually becomes the seal flap of the envelope.

The first step thereafter is to utilize a buckle fold as the sheet moves forwardly, to fold the leading end portion (the signatory portion) downwardly and rearwardly to thereby create a two layer fold. Thereafter, the sheet is scored transversely and the leading portion is folded upwardly and rearwardly through the use of another buckle fold along a line adjacent the medial portions of the sheet, so that the letter portion lies in superimposed relation to most but not all of the envelope portion and does not extend outwardly to cover the more lateral portions thereof. In this position, the signatory portion or panel becomes the uppermost of three layers, with the envelope portion being the bottom layer, and the side seams extending laterally outwardly beyond the side edges of the superimposed letter portion.

Both the envelope portion and the letter portion assembly are then simultaneously scored transversely, along a line extending adjacent the medial area of the envelope portion, along the free edge of the signatory panel, and adjacent the end of the side seams. At the same time, scoring is applied to the envelope portion transversely along the free end thereof to define the seal flap and also parallel and just outwardly of the side edges of the signatory panel, to define the side seams.

The next step involves separating the envelope portion and letter portion into two discrete sheets by cutting away a small section of each just inwardly of the line along which the second buckle fold was accomplished. This produces an envelope sheet in flat extended position with its major portion covered by a superimposing letter sheet, the latter having a signatory panel folded and extending as the third and top layer which is disposed above the trailing half of the envelope portion.

The side seams are then folded inwardly and adhesive is applied to their upper surface after such folding.

Thereafter, the forward portions of both sheets are simultaneously folded upwardly and rearwardly along their prior transverse scoring line. This brings the salutation portion of the letter sheet into superimposed relation to the signatory and main body portion of the letter, with the latter on the bottom, thereby creating the desired business fold. At the same time, it brings the forward area of the envelope portion into superimposed and encompassing relation to the letter. As the side edges thereof engage the adhesive of the side seams, the construction of the envelope is completed, with the business-folded letter encompassed therewithin in separate detached relation.

Thereafter the envelope and letter assemblies are collated in superimposed relation to each other so as to expose only the seal flap portions thereof. Adhesive is then applied to the seal flaps as a group. After the adhesive is dried, the envelopes are passed through a refeeder which separates the individual envelopes and thereafter they are passed through a folding section which folds the flap over in a manner well known in the art.

BRIEF DESCRIPTION OF THE DRAWINGS

A detailed description of one preferred embodiment of the METHOD OF MAKING ENVELOPE AND LETTER ASSEMBLY WITH BUSINESS LETTER FOLD is hereafter described with specific reference being made to the drawings in which.

DETAILED DESCRIPTION OF THE INVENTION

The new method disclosed and claimed herein is comprised of providing either a plurality of separate blanks, or a roll of such blanks connected together, which are fed into a machine designed to practice the invention and sever the individual sheets from the roll as they pass therethrough. This is in accordance with well known prior art and, therefore, need not be shown and described in detail herein.

Figure 1:
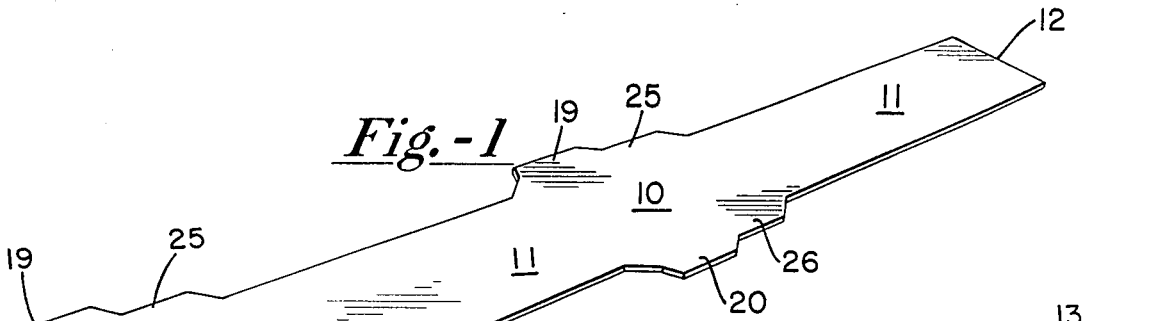
FIG. 1, is a plan view of a sheet of paper material comprised of a plurality of blanks each of which is cut to the desired shape as shown and may be utilized to produce an envelope assembly with a separate business-letter-folded removable enclosure therewithin, in accordance with our invention.

FIG. 1 shows two such blanks as they come off the roll. Each such blank is comprised of an envelope portion 1 and a letter portion 11, the latter of which is in the lead as it enters the machine. It will be seen that the letter portion 11 is rectangular in shape whereas the envelope portion 10, although generally rectangular in shape, has additional laterally extending portions at each of its sides which extend outwardly beyond the side edges of the letter portion 11. The letter is printed on the underside of the sheet with the signatory panel at the forward end portion. The name and address is printed on the underside of the envelope portion.

Figure 2A:
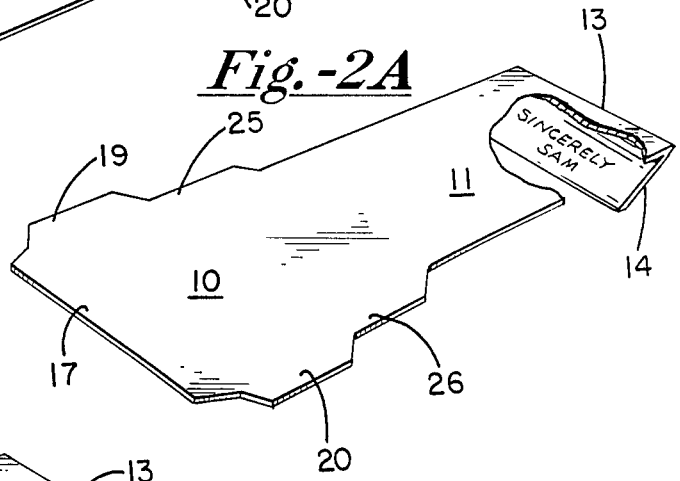
FIG. 2A is an illustrative perspective view of one such blank having an envelope portion and a letter portion, after the signatory panel of the latter has been buckle-folded downwardly.
Figure 2B:
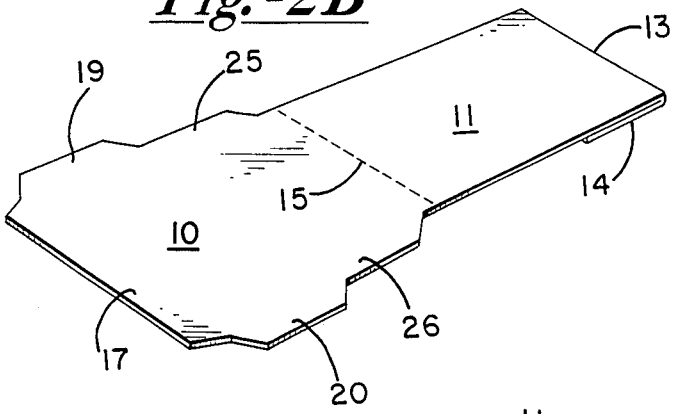
FIG. 2B is an illustrative perspective view of the same after being scored preparatory to the next buckle-fold.

FIG. 2A illustrates the first step in forming the envelope-letter assembly from one such blank as described above. As shown, the leading end or forward end area 12 is provided with a buckle-fold along the transverse line 13 to form a letter signatory end panel 14. The downward and rearward folding of the panel 14 brings that panel underneath the remainder of the letter portion 11, as shown in FIG. 2B.

As the sheet of paper moves forwardly, it is scored transversely along line 15, where the envelope portion 10 and letter portion 11 meet.

Figure 3A:
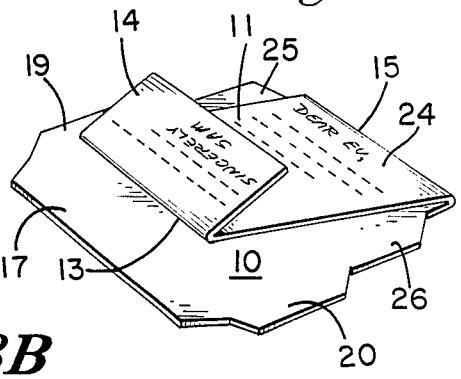
FIG. 3A is an illustrative perspective view of the same after the next step in which the letter end portion is buckle-folded upwardly and rearwardly into superimposed position with respect to the envelope portion.
Figure 3B:
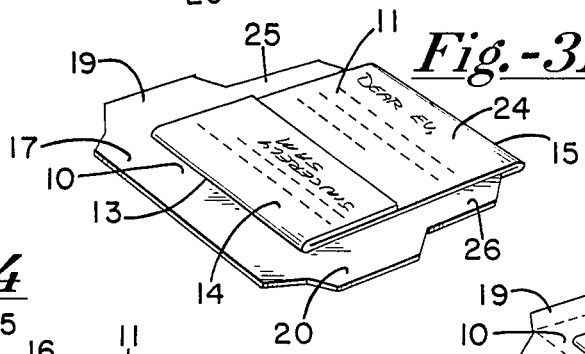
FIG. 3B is an illustrative perspective view of the same after the folding step of FIG. 3A has been completed.
Figure 4:
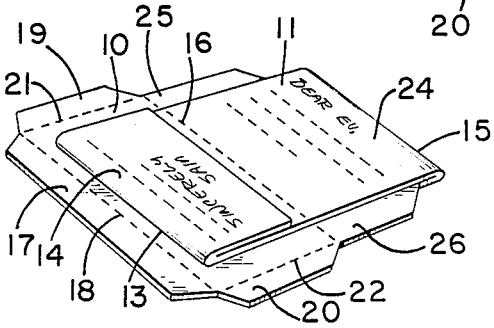
FIG. 4 is an illustrative perspective view of the same in which as the next step both of the envelope and letter portions are scored adjacent the medial portions of the envelope portion and the envelope portion is scored along its seal flap and side seams.

The next step is to produce a buckle-fold at line 15 where the envelope and letter portions adjoin, with the letter portion being folded upwardly and rearwardly to superimposed position with respect to the envelope portion 10, as shown in FIGS. 3A and 3B. It will be seen that the letter portion 11, after this fold has been accomplished, lies in superimposed relation to the envelope portion 10 and covers the major and central portion thereof. As a result of this folding operation, a three layered assembly is created, the envelope portion being the lower layer and the signatory portion of the letter being the top layer, as shown in FIG. 3A and FIG. 4. It will be understood that the signature may be applied to either side of the signatory portion or panel 14, depending upon the length of the letter, or even to some other area. The term "signatory panel" is used herein merely to identify the panel first formed at the end of the letter portion 11.

The next step is a scoring operation in which the envelope portion 10 and the letter portion 11 are simultaneously scored along line 16, which is a transverse line located slightly forwardly of the longitudinal center of the envelope portion 10 and just forwardly of the signatory panel 14. At the same time, the envelope portion 10 is scored along line 18 which extends transversely along the base of the seal flap 17. Also at the same time, the side seams 19 and 20 are defined by scoring a line along lines 21 and 22 at the base thereof. It will be noted that the score lines 21 and 22 extend parallel to the side edges of the letter portion 11 and are located outwardly thereof. These scoring operations are best shown in FIG. 4.

Figure 5:
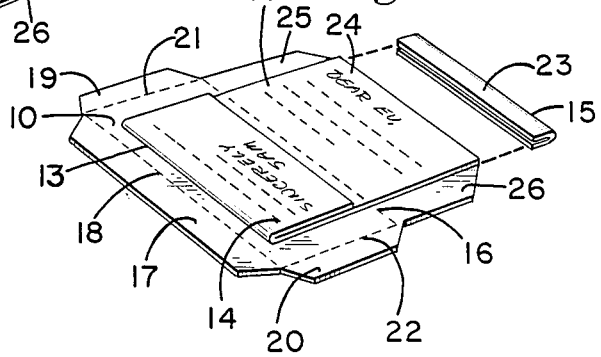
FIG. 5 is an illustrative perspective view of the same illustrating the next step in which a portion of both of the envelope and letter portions are severed and removed along their prior fold line.

FIG. 5 shows the next step in our method in which a portion 23 of both the envelope portion 10 and letter 11 portion is severed along a line adjacent to and parallel to fold line 15. This creates two separate sheets, the letter portion 11 lying in superimposed and aligned relation with the envelope portion 10, as best shown in FIG. 5.

Figure 6:
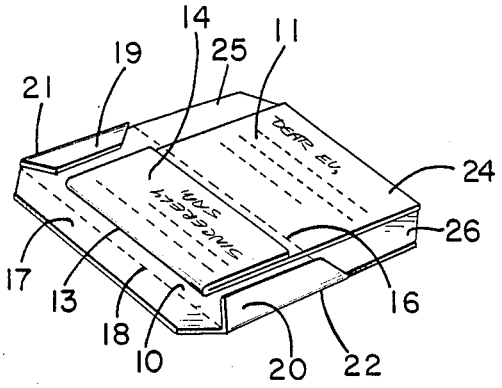
FIG. 6 is an illustrative perspective view of the same showing the next step in which the side seams of the envelope portion are turned inwardly.

FIG. 6 illustrates the next step in our method. It provides for the folding in-operation of the side seams 19 and 20. These side seams are folded upwardly and inwardly along score lines 21 and 22, as shown in that figure preparatory to the application of adhesive to the upperside thereof.

Figure 7:
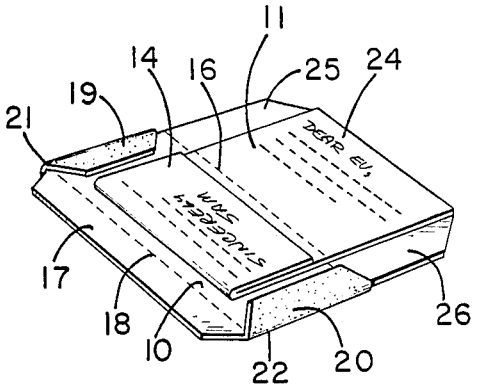
FIG. 7 is an illustrative perspective view of the same showing the next step in which adhesive is applied to the upper surface of the turned-in side seams.

FIG. 7 illustrates the next step which is the application of the adhesive to the upper surface of the side seams. It will be noted that the side seams extend inwardly short of the side edges of the letter portion 11 and opposite the laterally extending portions of the envelope portion adjacent the letter portion in the initial sheet.

Figure 8:
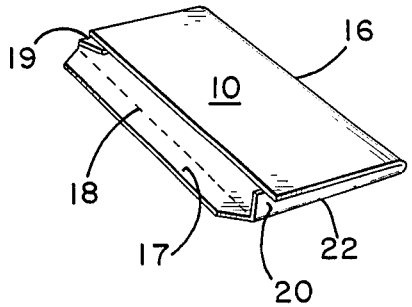
FIG. 8 is an illustrative perspective view of the same showing the next step in which the leading portions of both of the envelope and letter portions have been folded upwardly and rearwardly to produce a business-fold in the letter portion and to form the envelope in encompassing relation to the separate business-fold letter.

FIG. 8 illustrates the next step of our method in which the forward end of the assembly, shown in FIG. 7, is folded upwardly and rearwardly, the envelope portion 10 and the letter portion 11 being folded simultaneously in this manner while continuing to move forwardly through the machine. As this is done, the salutation panel 24 is folded rearwardly in superimposed relation to the signatory panel 14 of the letter and thus the business-letter folding is completed with the salutation panel 24 being the upper of three layers and the signatory panel 14 being disposed between the salutation panel and the main body or middle portion of the letter. Thus, the business-fold of the letter is accomplished by this folding step. At the same time, the laterally extending portions 25 and 26 of the envelope portion 11 are brought into engagement with the adhesive on the side seams 19 and 20 to complete the formation of the envelope. Thus, the letter is thereby completely encompassed by the envelope and lies therewithin in a business-fold such that as it is removed from the top of the envelope as, viewed in FIG. 8, the salutory panel 14 will open upwardly toward the viewer as a result of this business-fold. It will be seen that the letter is completely detached from the envelope and that it is completely encompassed by the envelope as a direct result of the folding operation described hereinabove.

Figure 9:
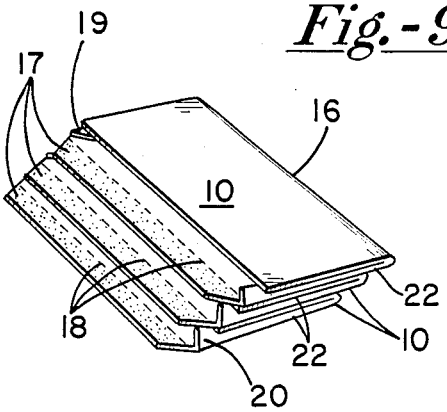
FIG. 9 is an illustrative perspective view of a plurality of such envelope assemblies, with business-fold letters therewithin, arranged for simultaneous application of adhesive to their seal flaps.
Figure 10:
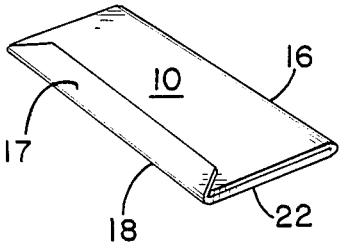
FIG. 10 is an illustrative perspective view of one of the above envelope assemblies after the seal flap has been folded over with the separate business-folded letter therewithin.

FIG. 8 shows the results of the folding operation described hereinabove. After the envelopes have been formed in the manner described hereinabove, they are collated in superimposed relation with only their seal flaps 17 exposed, as shown in FIG. 9. Adhesive is then applied to the exposed surfaces of the seal flaps, as shown in FIG. 9, and thereafter the envelopes are slightly separated and passed through a drying run to dry the adhesive on the seal flaps in a manner well known within the art, preparatory to the envelopes being fed into a re-feeder section. The re-feeder section separates the envelopes and arranges them in position for feeding into another section which folds the seal flap, as shown in FIG. 10, in which the seal flap 17 is folded upwardly and over the upper panel of the envelope.

From hereinabove it can be seen that we have provided a novel method of forming a discreet envelope-panel letter assembly in which the letter is folded so as to produce a business fold, thereby insuring that the recipient of the letter will be unable to detect in advance of reading the letter, that it is a product of bulk mailing. As the letter is removed from the envelope with the envelope held so that the backside thereof faces upwardly and the seal flap is at the right side, the salutation panel 15 will open upwardly, just as in the case of a letter prepared by a secretary with the now standard business-fold. In view thereof, such an envelope-letter assembly has proved much more highly desirable than those heretofore known, and yet can be produced at speeds equal to or exceeding the production of other envelope-letter assemblies as heretofore known.

The steps outlined hereinabove provide a highly improved result in that for the first time, it is now possible to produce a continuous stream of envelope-letter assemblies, each of which contains a letter having a business-fold and which opens up, upon withdrawal, so that its salutory heading faces the recipient. These highly desirable features are accomplished as a direct result of the unique steps outlined hereinabove, as explained and as claimed herein. None of the above prior art suggests how these long-desired results can be obtained and we know of no other way previously disclosed under which these results can be attained.

An envelope-letter asembly produced in accordance with the above steps is so highly desired because it makes it virtually impossible for the recipient to recognize that the letter has been mass produced mechanically. In other words, it cannot, upon being opend, be recognized at once as so-called "junk mail" and discarded with knowledge and confidence that the letter is not a valuable piece of correspondence, as is the case with letter-envelope assemblies produced by other methods.

The steps outlined hereinabove, when using modern methodology, produces such mailing pieces at a high rate of speed to effect economies, while at the same time increasing the personalized quality of the communication. Both the envelope and the letter can be separately personalized, even though they are formed from the same blank, and even more importantly, the letter has a business-fold which makes it appear to have been prepared by the author's secretary.

The steps outlined hereinabove can all readily be performed through the use of machines currently available for purchase on the market, with slight modifications thereto which are readily obvious to one skilled in the art, once the method is known.

In view thereof, in considering this invention, it should be remembered that the present disclosure is illustrative only and the scope of the invention should be determined by the appended claims.

What is claimed is:

1. A method of forming an envelope with a separate business-letter-folded removably enclosure, from a single elongated sheet of material having an envelope end portion and a central but somewhat narrower letter end portion with certain areas at each of the sides of said envelope portion extending laterally beyond the side edges of said letter end portion, said method having the steps of:

(a) transversely folding an end section of said letter end portion back upon said letter end portion in a predetermined direction and thereby forming a panel extending along one side of the remainder of said letter end portion;

(b) folding said sheet of material back upon itself in an opposite direction along a transverse fold line adjacent the juncture of said letter end portion and said envelope end portion to thereby form a triple layer, with said panel being one of the outermore of said layers;

(c) severing said envelope portion from said letter end portion along a transverse line adjacent said fold line to form two separate pieces of sheet material in superimposed relation; and (d) folding said two separate pieces of sheet material simultaneously in said opposite direction each into folded superimposed engaging relation with itself to thereby form a quintuple layer which comprises an envelope with a removable business-letter-folded enclosure therewithin in which said first folded panel is the innermost layer of the letter.

2. The method of claim 1 further comprising the step of applying adhesive material to said certain areas of said envelopes end portion which are wider than said letter end portion before the simultaneous folding of both pieces of sheet material of step (d).

3. The method of claim 2 wherein said adhesive material is applied to two opposite areas of one of said separate simultaneously folded pieces before the simultaneous folding of both pieces of sheet material, said adhesive being applied to areas which are in position to be engaged by other folded areas of said envelope end portion upon said simultaneous folding of said sheets.

4. The method of claim 1 wherein the folding of step (a) is performed in a downward direction.

5. The method of claim 1 and printing prior to step (a) a signatory closing upon the surface of said panel which faces away from said letter end portion immediately subsequent to step (a).

6. The method of claim 1 and printing a salutation of a letter upon said sheet of material on the outer surface of that area of the letter end portion that is formed into a separate sheet of material by step (c) which is located adjacent said line of severance.

7. The method of claim 1 wherein said panel and the remainder of said letter portion cover the major portion of said envelope portion when folded back thereover by step (b).

8. The method of claim 1 and printing the signatory portion of a letter upon the area of said sheet of material which becomes said panel by step (a), before said panel is formed.

9. The method of claim 1 and printing a salutation portion of a letter prior to step (a) upon a surface of said letter portion adjacent to said envelope end portion.

10. The method of claim 1 and printing prior to step (a) a signatory closing upon the surface of said panel which is folded back upon said letter end portion in step (a).

11. A method of forming an envelope with a separate business-folded removable letter enclosed therewithin from a single elongated sheet of material having an envelope portion and a central but somewhat narrower letter portion with certain areas at each of the sides of said envelope portion extending laterally outwardly beyond the side edges of said letter end portion, said method having the steps of:

(a) folding an end section of said letter end portion back upon itself in a predetermined direction and thereby forming a signatory panel extending along one side of the remainder of said letter end portion;

(b) folding said sheet of material back upon itself in an opposite direction along a transverse fold line adjacent the juncture of said letter end portion and said envelope end portion to thereby form a triple layer, with said panel being one of the outermore layers and the envelope portion being the other outermore layer;

(c) severing said envelope portion from said letter end portion along said fold line to form two separate pieces of sheet material in superimposed relation to each other; and (d) folding said two separate pieces of sheet material back upon themselves simultaneously in said opposite direction each into superimposed inter-engaging relation with itself to thereby form a quintuple layer which comprises an envelope with a removable business-letter-folded enclosure therewithin in which said first folded panel is the innermost layer of the letter.

12. The method defined in claim 11 and applying adhesive prior to step (d) to some of said certain areas of said envelope portion, and bringing other of said areas of said envelope portion into registering relation therewith as a result of step (d) to form an envelope encompassing the folded separate piece of sheet material carrying said panel.

13. The method defined in claim 11 wherein the folding of step (a) is accomplished in a downward direction and the folding in steps (b) and (d) are accomplished in an upward direction.

14. The method defined in claim 11 and transversely scoring simultaneously between step (b) and step (c) said envelope portion and said letter portion adjacent the medial area of said envelope portion.

15. The method defined in claim 11 and scoring between step (b) and step (c) said envelope portion longitudinally along the inner border of said certain areas thereof.

16. A method of forming from a single elongated sheet of material having an envelope portion and a central but somewhat narrower letter portion with certain areas of said envelope portion extending laterally outwardly beyond the side edges of said letter end portion, an envelope with a separate business-letter-folded removable enclosure, having the steps of:

(a) folding an end section of said letter end portion of said sheet back upon said letter end portion in a given direction and thereby forming a panel extending along one side of that end portion of said sheet;

(b) folding said sheet of material back upon itself in an opposite direction along a transverse fold line located intermediate said panel and the opposite end portion of said sheet to form a triple layer with the latter, with said panel being one of the outermore of said layers and said opposite end portion being the other outermore layer;

(c) severing and removing a portion of said sheet adjacent said last mentioned fold line to form two separate pieces of sheet material in superimposed relation; and (d) folding said two separate pieces of sheet material over said panel simultaneously in said opposite direction to bring said laterally extending areas of said envelope into registry and thereby form a quintuple layer which comprises an envelope with a removable business-letter-folded enclosure therewithin in which said first folded panel is the innermost layer of the letter.

17. The method defined in claim 16, and between steps (b) and step (d), applying adhesive to some of said outwardly extending areas of said envelope portion.

18. The method defined in claim 16, with said panel being the middle layer of said quintuple layer.

* * * * *

UNITED STATES PATENT AND TRADEMARK OFFICE

CERTIFICATE OF CORRECTION

PATENT NO. : 4,731,048

DATED : March 15, 1988

INVENTOR(S) : Gary L. Marella and David T. Gardella

It is certified that error appears in the above-identified patent and that said Letters Patent are hereby corrected as shown below:

Column 1 line 56 change "to" to --for-- column 2 line 19 change "particularity" to -- particularily --.

column 2 line 21 change "an" to --as-- column 2 line 24 change "than" to --that-- column 2 line 63 change "of" to --for-- column 3 line 34 take out "a" second occurrence column 5 line 48 change "l" to --10-- column 7 line 59 change "opend" to --opened--

Signed and Sealed this

Twenty-second Day of November, 1988

*Attest:*

DONALD J. QUIGG

*Attesting Officer*

*Commissioner of Patents and Trademarks*